US006951450B1

(12) United States Patent
Figura et al.

(10) Patent No.: US 6,951,450 B1
(45) Date of Patent: Oct. 4, 2005

(54) VARIABLE GEOMETRY TURBOCHARGER

(75) Inventors: Giorgio Figura, Thaon-les-Vosges (FR); Denis Jeckel, Thaon-les-Vosges (FR); Eric Dechanet, Thaon-les-Vosges (FR)

(73) Assignee: Honeywell International, Inc., Morristown, NJ (US)

( * ) Notice: Subject to any disclaimer, the term of this patent is extended or adjusted under 35 U.S.C. 154(b) by 128 days.

(21) Appl. No.: 10/332,840

(22) PCT Filed: Jul. 19, 2000

(86) PCT No.: PCT/FR00/02068

§ 371 (c)(1),
(2), (4) Date: Jan. 13, 2003

(87) PCT Pub. No.: WO02/06637

PCT Pub. Date: Jan. 24, 2002

(51) Int. Cl.[7] ..... F04B 17/00; F01B 25/02
(52) U.S. Cl. ..... 417/407; 415/164; 415/214.1
(58) Field of Search ..... 417/406, 407; 114/204, 206, 164, 214.1; 415/204, 206, 415/164, 214.1

(56) References Cited

U.S. PATENT DOCUMENTS

| | | | | |
|---|---|---|---|---|
| 2,801,043 A | | 7/1957 | Spotz | 230/116 |
| 2,860,827 A | * | 11/1958 | Egli | 415/164 |
| 3,033,519 A | * | 5/1962 | Radtke | 415/164 |
| 4,557,665 A | | 12/1985 | Szczupak | |
| 4,657,476 A | * | 4/1987 | Berg | 415/48 |
| 4,659,295 A | * | 4/1987 | Burdette et al. | 417/407 |
| 4,679,984 A | | 7/1987 | Swihart et al. | |
| 4,726,744 A | | 2/1988 | Arnold | 417/405 |
| 4,741,666 A | | 5/1988 | Shimizu et al. | 415/158 |
| 4,804,316 A | | 2/1989 | Fleury | |
| 4,907,952 A | | 3/1990 | Inoue et al. | |
| 5,146,752 A | * | 9/1992 | Bruestle | 60/602 |
| 5,207,565 A | * | 5/1993 | Roessler | 417/407 |
| 5,231,831 A | | 8/1993 | Leavesley | |
| 5,441,383 A | | 8/1995 | Dale et al. | |

FOREIGN PATENT DOCUMENTS

| | | | |
|---|---|---|---|
| EP | 0 079 435 | 5/1983 | F04D 29/40 |
| EP | 0 982 482 | 3/2000 | F02C 6/12 |
| GB | 1 263 932 | 2/1972 | F01D 25/24 |
| WO | WO 01/53679 | 7/2001 | |
| WO | WO 02/06637 | 1/2002 | |

* cited by examiner

*Primary Examiner*—Charles G. Freay
(74) *Attorney, Agent, or Firm*—Chris James

(57) ABSTRACT

A cartridge is formed by an insert fixed to a base to form turbine intake nozzles in which vanes are rotatably mounted, and the base is fixed to a center housing. A separate exhaust housing which is formed from sheet metal is fixed to the cartridge outside of the insert in order to provide an intake and an outlet for exhaust gases driving a turbine wheel on a shaft journaled in the center housing.

9 Claims, 6 Drawing Sheets

VARIABLE GEOMETRY TURBOCHARGER

BACKGROUND OF THE INVENTION

1. Field of the Invention

This invention relates generally to the field of turbochargers having variable turbine inlet geometries. More particularly, the present invention provides a structural arrangement for variable inlet vane support independent of the turbine housing.

2. Description of the Related Art

In a turbocharger it is often desirable to control the flow of exhaust gas into the turbine to improve the efficiency or operational range. Various configurations of variable nozzles have been employed to control the exhaust gas flow. Multiple pivoting vanes annularly positioned around the turbine inlet and commonly controlled to alter the throat area of the passages between the vanes is an approach which has been successfully used in prior turbochargers. Various approaches to this method for implementing a variable nozzle are disclosed in U.S. Pat. No. 4,679,984 to Swihart et al. entitled "Actuation System for Variable Nozzle Turbine" and U.S. Pat. No. 4,804,316 to Fleury entitled "Suspension for the Pivoting Vane Actuation Mechanism of a Variable Nozzle Turbocharger" having a common assignee with the present application.

While multiple vane variable nozzle turbochargers have significantly increased the overall efficiency and capability of turbochargers, the complexity of support and actuation structures for the vanes have increased manufacturing costs and occasionally created maintenance issues. Additionally, connection of the vane support structure to the turbine housing limits flexibility in turbine housing design and structure. Turbine housings are a significant thermal load which can affect emissions systems performance in automotive applications. Further, integration of turbine housings into the exhaust manifold can provide a reduction in parts count and complexity for an automotive turbocharger installation. It is therefore desirable to provide variable nozzle structural support arrangements independent of the turbine housing to improve the actuation systems to increase reliability and reduce manufacturing costs for turbochargers employing them.

SUMMARY OF THE INVENTION

A variable geometry turbocharger employing the present invention includes a centre housing having a centre bore to carry a bearing assembly supporting a shaft with a turbine wheel mounted at a first end and a compressor impeller mounted at a second end. A compressor housing enclosing the impeller is attached to the centre housing and incorporates an air inlet and a compressed air outlet.

A cartridge having a base and an insert is attached to the centre housing opposite the compressor housing. The cartridge includes a base and an insert. The base and insert mutually forming an exhaust inlet nozzle and the nozzle incorporates an exhaust outlet with aerodynamic contour matching the turbine wheel.

A plurality of vanes having rotation posts extending from a first surface substantially parallel to the inner nozzle wall provide the variable nozzle. The posts are received in circumferentially spaced apertures in the base on the inner nozzle wall. The posts have actuation arms extending for engagement in indentations in a unison ring that is engaged between the centre housing and the base.

Actuation of the unison ring is accomplished by a crank having an actuating arm engaging a slot in the unison ring. The crank is moveable continuously from a first position to a second position, causing the actuation arm to translate in the radial slot and imparting force perpendicular to the radial slot to urge rotation motion of the unison ring. The rotational motion of the unison ring causes the vane arms to rotate the vanes.

A sheet metal exhaust housing is mounted on the cartridge on the centre housing, providing an inlet for exhaust gas into the nozzle.

DETAILED DESCRIPTION OF THE PRESENTLY PREFERRED EMBODIMENTS

Figure 1:
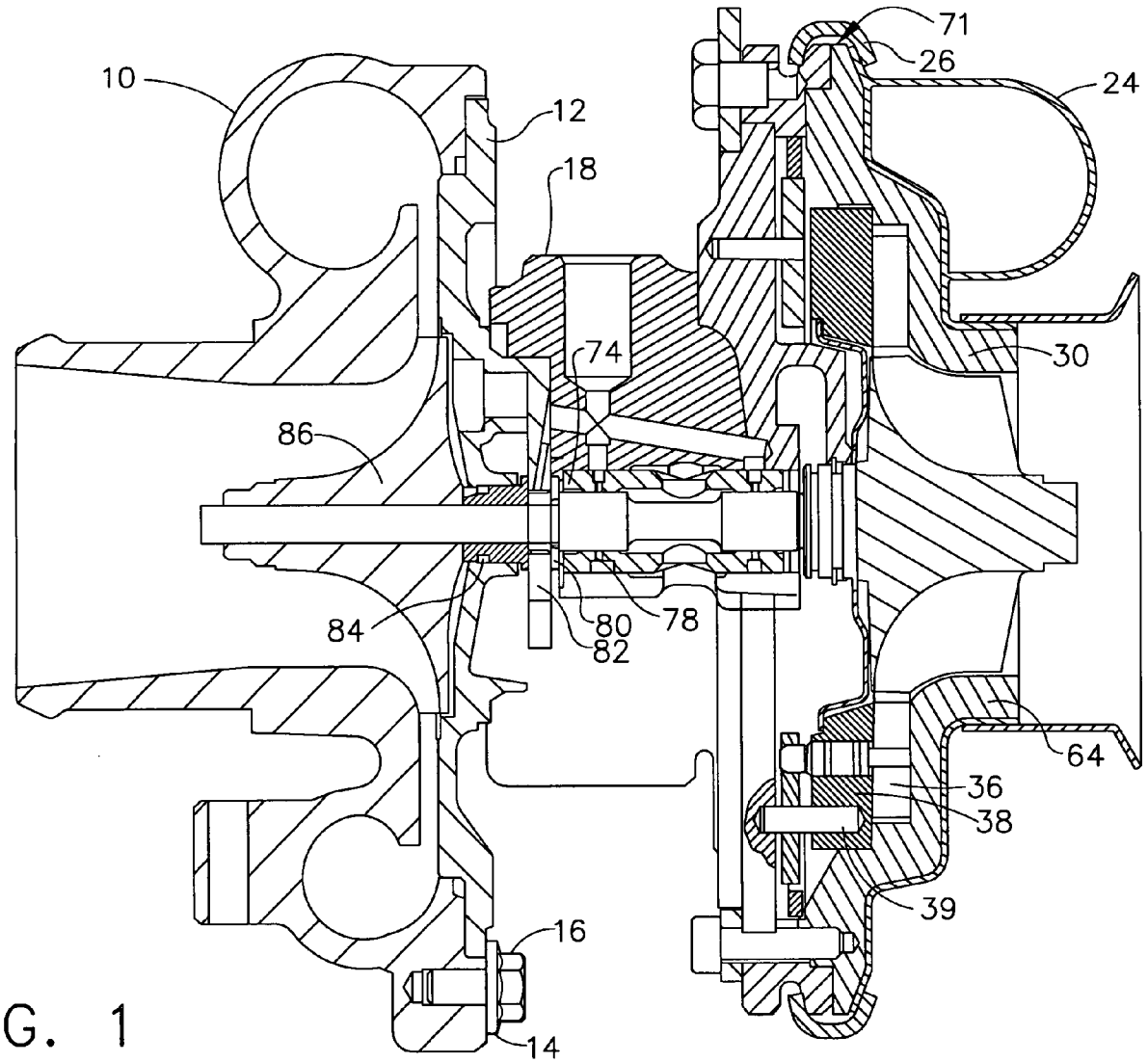
FIG. 1 is an elevation view of an embodiment of a turbocharger employing the present invention.

Referring to the drawings, the embodiment of the invention shown in FIG. 1 includes a compressor housing 10 which is connected to a backplate 12 using two or more clamps 14 secured by bolts 16. The backplate is attached to a centre housing 18 with multiple bolts 20 and a seal ring 22. For the embodiment shown a sheet metal exhaust housing 24 is connected to the centre housing using bands 26 secured by bolts 28. Exhaust gas or other high energy gas supplying the turbocharger enters the exhaust housing through inlet 32.

As best seen in FIGS. 2*a*, 2*b*, 3 and 4, a cartridge, generally designated 34 is mounted to the centre housing. A turbine wheel and shaft assembly 30 is carried by the bearings with the turbine wheel suspended within the cartridge. Multiple vanes 36 are mounted to a cartridge base 38. The vanes pivot on posts 40 extending from the vanes into holes 42 in a surface 43 on the base which forms the inner inlet nozzle wall. Actuation arms 44 extend from the vane posts to be engaged by indentations 46 in unison ring 48. An actuator crank 50 terminates at a first end in a lever arm 52 carrying a pin 54 to engage slot 56 in the unison ring for rotation of the ring. The crank extends from a boss 58 in the centre housing passing through a bushing 60 terminating on an external arm 62 for engagement by an actuator.

Figure 2A:
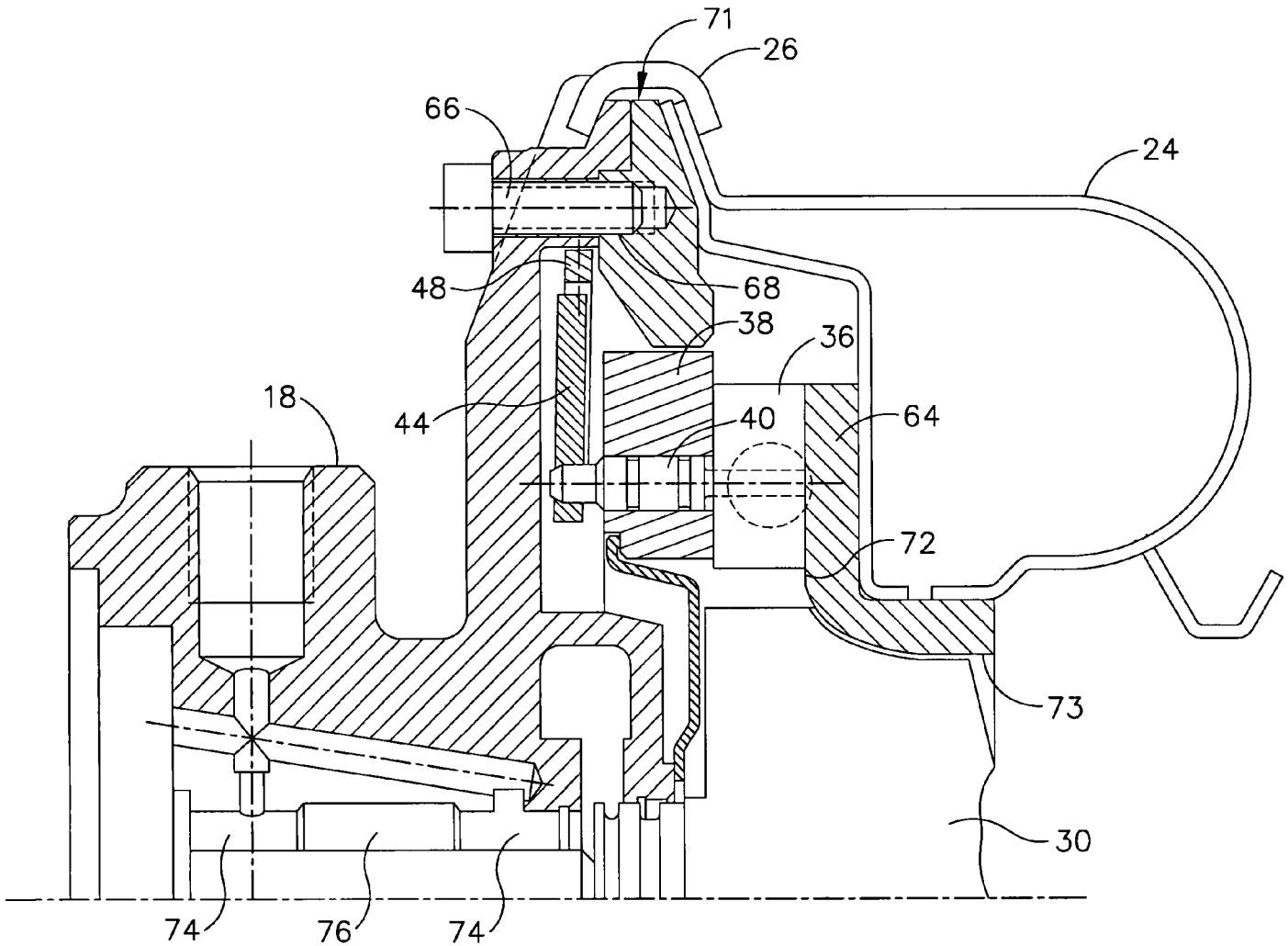
FIG. 2*a* is a side section half elevation about the centreline showing details of an exhaust housing, centre housing and cartridge assembly with the turbine shaft wheel assembly as supported by the bearing system.
Figure 2B:
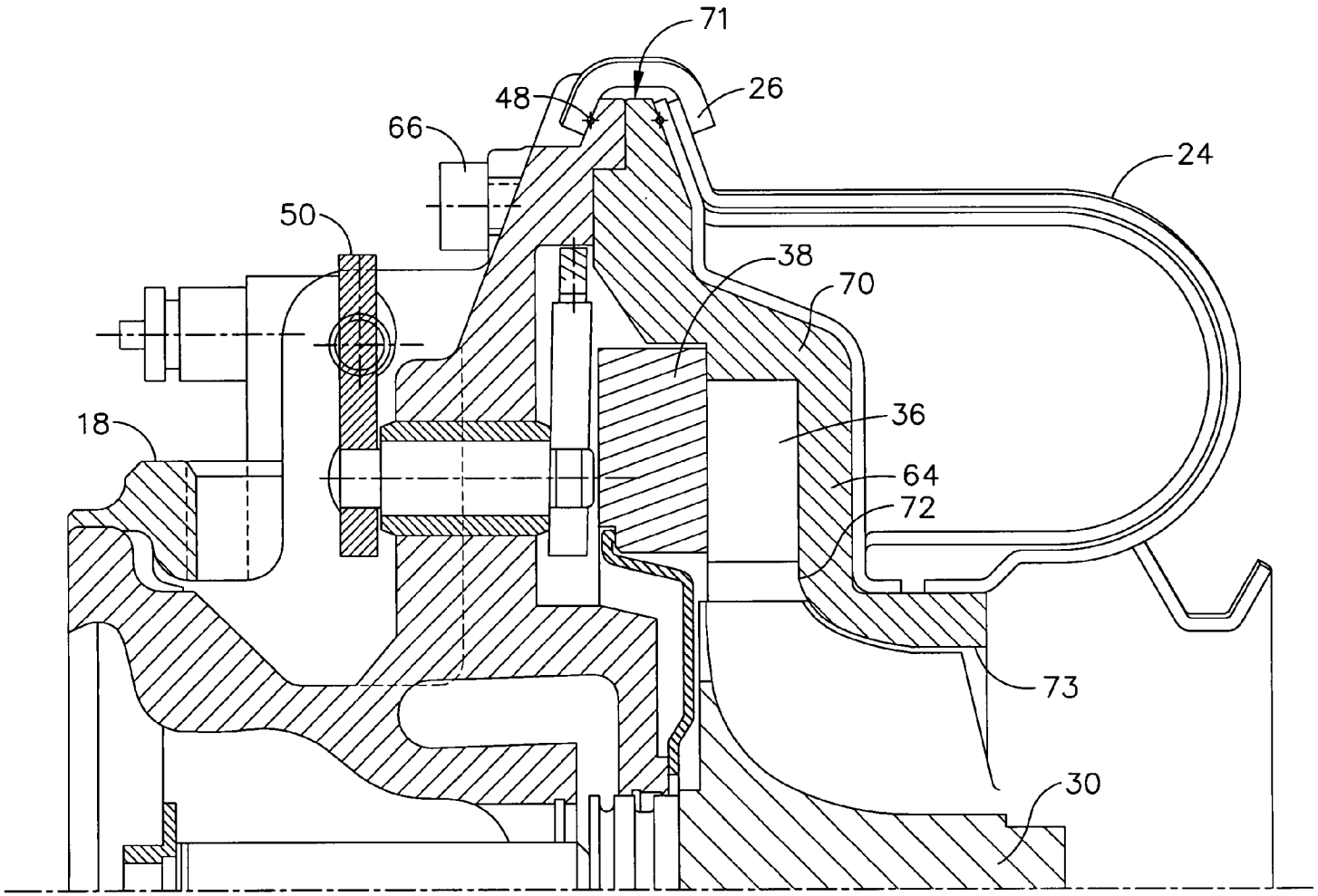
FIG. 2*b* is a side section half elevation in a plane pivoted from FIG. 2*a* to show additional details of the cartridge.
Figure 3:
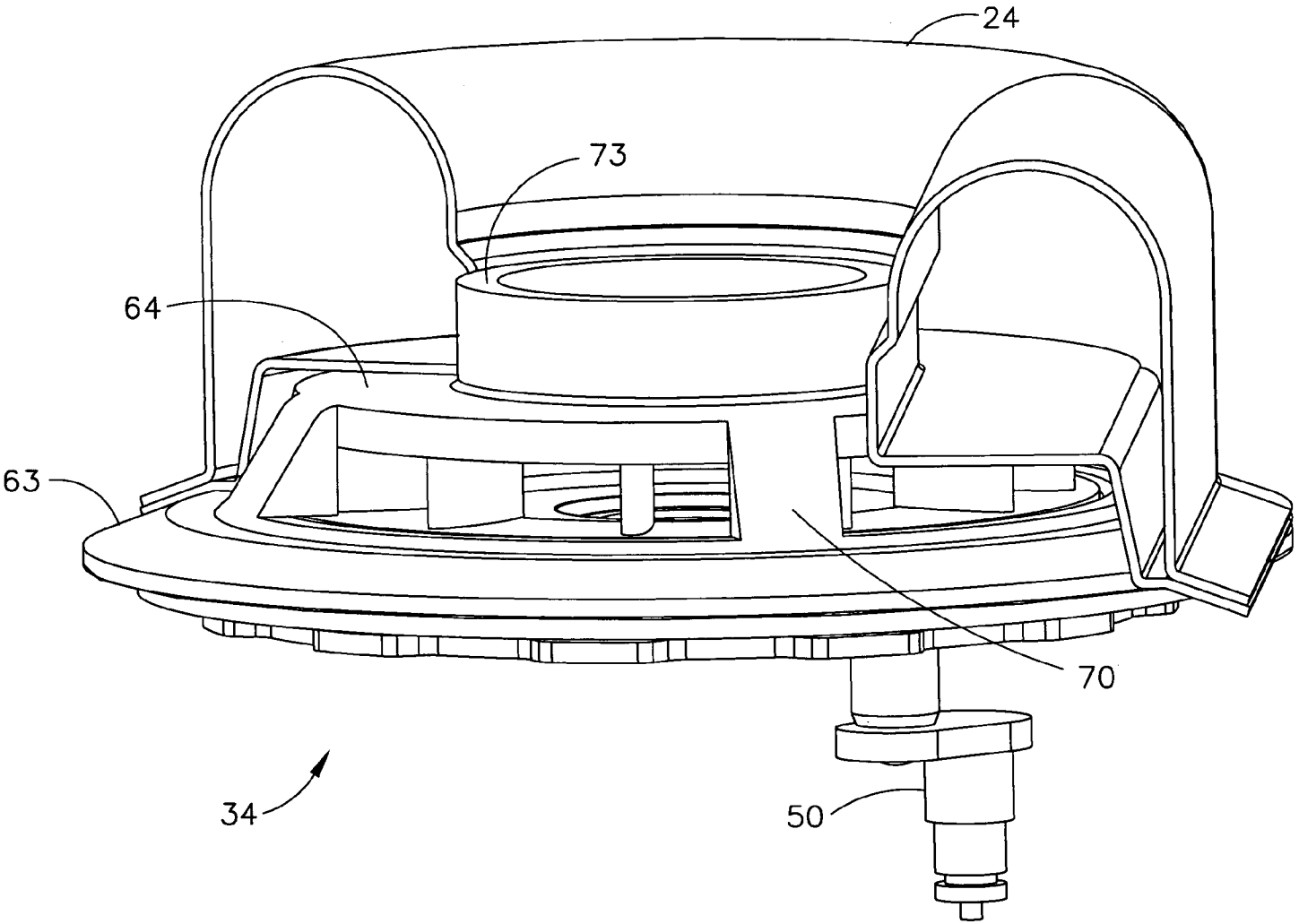
FIG. 3 is an pictorial view of the centre housing and cartridge assembly showing an embodiment according to the invention with the exhaust housing partially removed.
Figure 4:
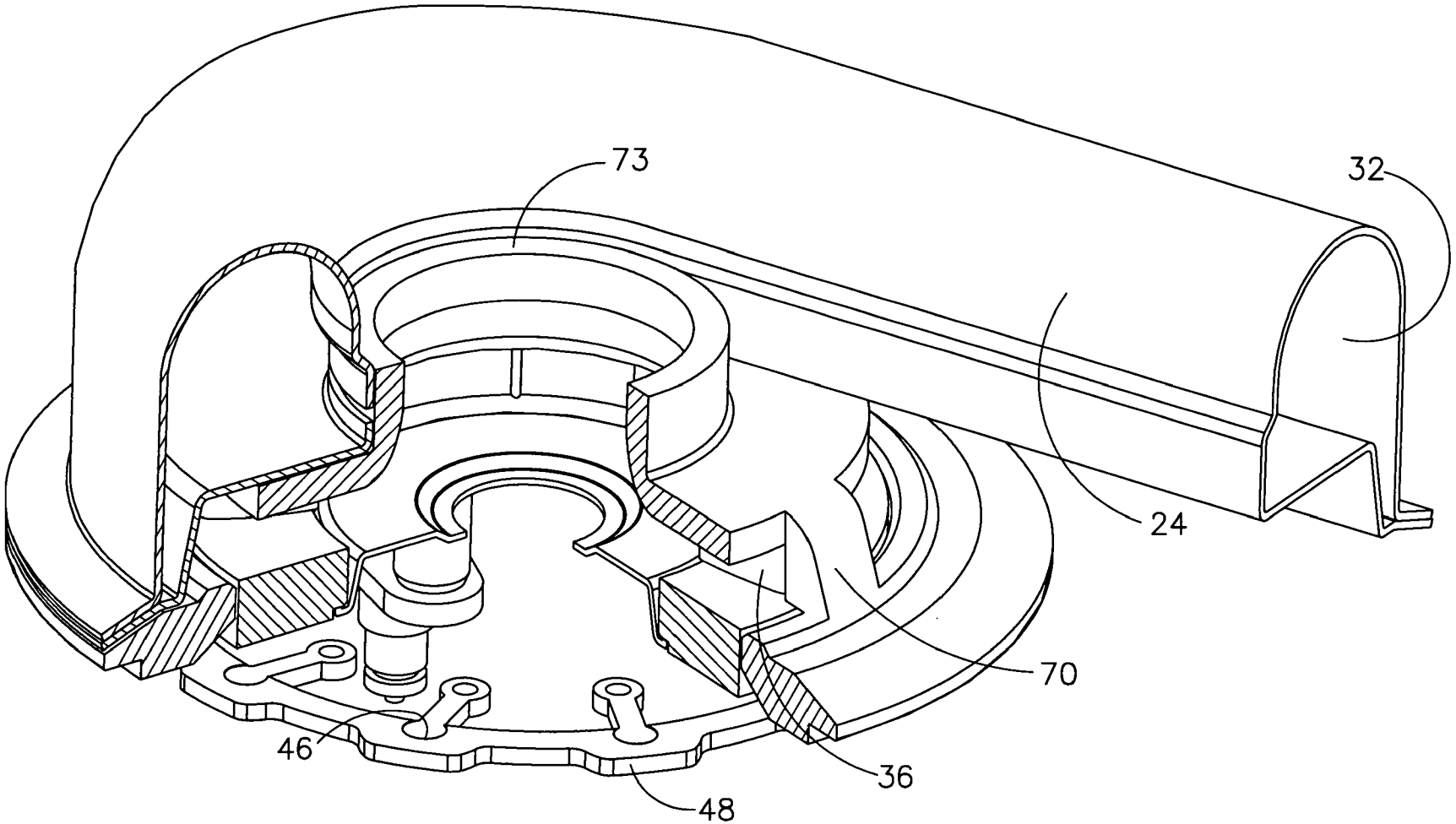
FIG. 4 is a second view of the centre housing and cartridge assembly with the insert sectioned to reveal the variable geometry nozzle vanes.
Figure 5:
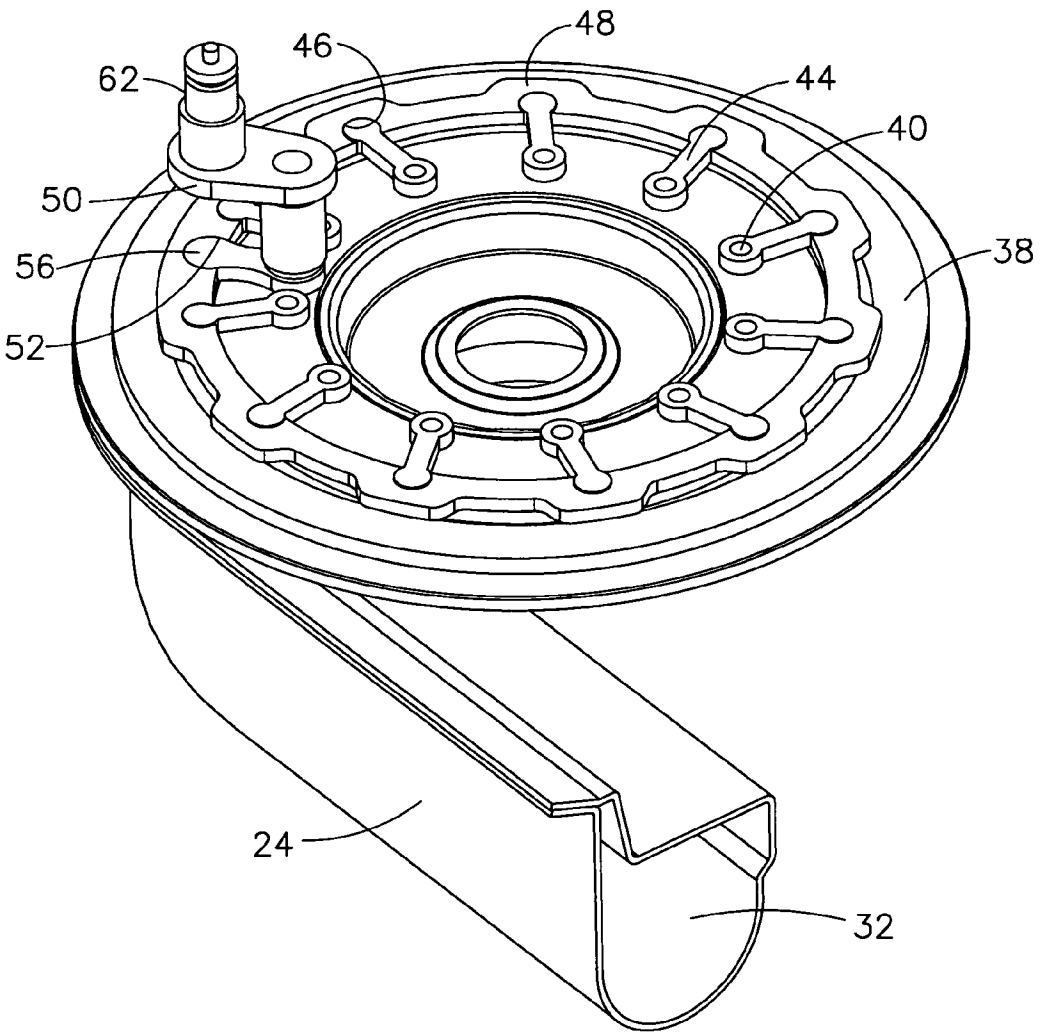
FIG. 5 is a bottom pictorial view of the variable geometry vane arms, partial unison ring and vane crank assembly shown.

An insert 64, best seen in FIGS. 2*a*, 2*b* and 3 is attached to the center housing by bolts 66 received in holes 68. Support posts 70 hold the base 38 against spacer pins 39 (best seen in FIG. 1) received in the center housing 18. Rim 71, which extends around the circumference of the insert, is also engaged by the V-band clamp 26. The insert incorporates the outer wall of the nozzle 72 with immediate proximity to the vanes 36. Additionally, the insert 64 provides the exhaust gas outlet of the turbine 73 with aerodynamic contour matching the blades on the turbine wheel. The insert 64 and base 38 with the attached vanes 36 and actuation elements 44 form the cartridge 34, which is separated from both the center housing 18 and exhaust housing 24 and attached between those two components. Use of the cartridge 34 of the present invention allows the exhaust housing 24 to be simplified over prior art designs facilitating such improvements as a sheet metal exhaust housings shown in the embodiments of the drawings.

Returning to FIG. 1, a bearing system having two bearings 74 and a bearing spacer 76 or, in alternative embodiments, a unitary bearing, supports the shaft wheel assembly in the centre bore of the centre housing 78. The shaft further extends through a support collar 80 which engages a support bearing 82 carried between the centre housing and compressor back plate. A piston ring 84 seals the support collar with the shaft bore in the back plate. The compressor impeller 86 is attached to the shaft wheel assembly.

Having now fully described the invention as required by the patent statutes, those skilled in the art will be able to ascertain modifications and alterations to the specific embodiment disclosed herein. Such modifications and alterations are within the scope of the invention as defined in the following claims.

What is claimed is:

1. A variable geometry turbocharger comprising:

a center housing having a center bore carrying a bearing assembly;

a turbine wheel attached to a shaft extending through the center bore and supported by the bearing assembly;

a cartridge comprising a base having an inner nozzle wall, an insert having an outer nozzle wall spaced from said inner nozzle wall, a plurality of vanes rotatably mounted between said inner nozzle wall and said outer nozzle wall, and an exhaust outlet with aerodynamic contours substantially matching the turbine wheel, with said cartridge being fixed to the center housing;

means for rotating said vanes;

a compressor impeller attached to said shaft distally with respect to said turbine wheel;

a compressor housing attached to said center housing opposite said cartridge and enclosing the compressor impeller, said compressor housing having a compressed air inlet and a compressed air outlet; and an exhaust housing attached to said cartridge opposite from said center housing solely by circumferential fixation to the exterior of said cartridge by a V-band clamp securing a rim comprising a portion of said exhaust housing and a portion of said cartridge, said exhaust housing having an inlet and an outlet for exhaust gas.

2. A variable geometry turbocharger as in claim 1 wherein said means for rotating said vanes comprises:

a plurality of posts extending from respective said vanes and received in respective circumferentially spaced apertures in said inner nozzle wall;

a plurality of actuation arms fixed to respective said posts;

a unison ring situated intermediate said center housing and said base, said unison ring having a plurality of indentations equal in number to the plurality of vanes, said actuation arms being received in respective said indentations, said unison ring further having a slot; and a crank having a lever arm engaging the slot, said crank being moveable from a first position to a second position so that said unison ring rotates and said actuation arms and said vanes rotate with said posts.

3. A variable geometry turbocharger as in claim 1 wherein said exhaust housing is formed of sheet metal.

4. A variable geometry turbocharger comprising:

a turbocharger housing;

a variable inlet vane support comprising an inner nozzle wall and an outer nozzle wall spaced from said inner nozzle wall to form a nozzle and forming a cartridge including a base defining said inner nozzle wall and an insert defining said outer nozzle wall;

a plurality of vanes supported between the inner nozzle wall and the outer nozzle wall; and a mechanism for rotating said vanes;

wherein the variable inlet vane support is separate from said turbocharger housing, the turbocharger housing being fixed to the exterior of the variable inlet vane support by circumferential fixation to the exterior of the cartridge forming a part of the variable inlet vane support by a V-band clamp securing a rim comprising a portion of said turbocharger housing and a portion of said cartridge.

5. A variable geometry turbocharger as in claim 4 wherein said turbocharger housing comprises a center housing, said turbocharger further comprising a turbine wheel attached to a shaft journaled in said center housing.

6. A variable geometry turbocharger as in claim 4 wherein said turbocharger housing comprises an exhaust housing fixed outside of said cartridge and comprises an inlet for exhaust gas into the nozzle.

7. A variable geometry turbocharger as in claim 5 wherein said cartridge is fixed to said center housing by fitting said insert in said center housing.

8. A variable geometry turbocharger as in claim 5 wherein said insert is fixed to said center housing and said cartridge is attached to said turbocharger housing is by a V-band clamp securing a rim comprising a portion of the exhaust housing forming a part of the turbocharger housing and a portion of the cartridge.

9. A variable geometry turbocharger as in claim 4 wherein said mechanism for rotating said vanes comprises:

a plurality of posts extending from respective said vanes and received in respective circumferentially spaced apertures in said inner nozzle wall;

a plurality of actuation arms fixed to respective said posts;

a unison ring situated intermediate said center housing and said base, said unison ring having a plurality of indentations equal in number to the plurality of vanes, said actuation arms being received in respective said indentations, said unison ring further having a slot; and a crank having lever arm engaging the slot, said crank being moveable from a first position to a second position so that said unison ring rotates and said actuation arms and said vanes rotate with said posts.

* * * * *